US006412775B1

(12) United States Patent
Dear

(10) Patent No.: US 6,412,775 B1
(45) Date of Patent: Jul. 2, 2002

(54) COMPATIBILITY-TESTING AMUSEMENT DEVICE WITH AN ELECTRICAL CIRCUIT

(76) Inventor: David Dear, 283 Avenue C, Apt. 7H, New York, NY (US) 10009

( * ) Notice: Subject to any disclaimer, the term of this patent is extended or adjusted under 35 U.S.C. 154(b) by 0 days.

(21) Appl. No.: 09/542,566

(22) Filed: Apr. 4, 2000

(51) Int. Cl.[7] ..... A63F 9/00

(52) U.S. Cl. ..... 273/138.2; 273/455; 273/460; 273/161

(58) Field of Search ..... 273/454, 453, 273/455, 444, 459, 460, 161, 138.2; 446/484, 485, 491

(56) References Cited

U.S. PATENT DOCUMENTS

| | | | | | |
|---|---|---|---|---|---|
| 2,379,955 | A | * | 7/1945 | Eilnberger | 273/161 |
| 3,851,875 | A | * | 12/1974 | Breslow et al. | 273/455 X |
| 4,508,520 | A | * | 4/1985 | Sellers et al. | 446/485 |
| 4,737,131 | A | * | 4/1988 | Sirota | 446/484 X |
| 4,765,623 | A | * | 8/1988 | Cardillo et al. | 273/161 |
| 4,836,823 | A | * | 6/1989 | Laven | 446/485 |
| 5,482,277 | A | * | 1/1996 | Young | 273/161 |

* cited by examiner

*Primary Examiner*—Raleigh W. Chiu

(57) ABSTRACT

A compatibility-testing amusement device with an electrical circuit comprises a heart-shaped housing, which comprises an exterior surface and interior area formed therein. The interior area comprises a power source, a substantially low voltage incomplete power circuit, a central processing unit, and a speaker. A left side of the heart-shaped housing comprises a metal contact upon the exterior surface thereof, and a right side of the heart-shaped housing comprising a metal contact upon the exterior surface thereof. A center portion of the heart-shaped housing comprises an aperture thereon, through which a speaker protrudes from the interior area. Touching of the left side metal contact by a first person, touching of the right side metal contact by a second person, and subsequent touching of the first person and second person to each other via kissing causes the substantially low voltage power circuit to become complete. Completion of the circuit causes the central processing unit to direct a sound module to play at least one random, unpredictable sound through usage of the speaker or at least one light to be displayed through usage of an illumination source. The sound or light is intended to represent a level of compatibility between the first person and second person.

7 Claims, 3 Drawing Sheets

COMPATIBILITY-TESTING AMUSEMENT DEVICE WITH AN ELECTRICAL CIRCUIT

BACKGROUND OF THE INVENTION

1. Field of the Invention

The present invention is an amusement device, which, in the preferred mode, consists of a plastic, heart-shaped apparatus. Both the left side and right side of the device comprise at least one metal contact, and a sound module, speaker, and illumination means appear on the surface thereof. When the device is held by two persons touching each respective metal contact, an incomplete, low-voltage power circuit is created. When the two players kiss, the circuit is completed due to their physical contact, and a random sound and/or random type of light occurs. Such random sound and/or random type of light is indicative of whether or not the players share true love. Accordingly, the present invention can be used as an amusement device for multiple combinations of players at a party or other social setting.

2. Description of the Prior Art

Many innovations for amusement devices with electrical circuits are provided in the prior art, described as follows. Although these inventions are suitable for the purposes they address, they differ from the present invention as contrasted herein. Following is a summary of patents most relevant to the invention at hand, including description of differences between features of the invention and those of the prior art.

1. U.S. Pat. No. 3,851,875, invented by Breslow et al., entitled "Electrical Game Apparatus Using A Human Body As Part Of A Circuit"

The patent to Breslow describes an electric game which includes an incomplete circuit. A sound signal mechanism and an electrical power source are connected to the circuit. The incomplete circuit, which defines a partial conductive path for electricity, includes two spaced apart terminals and a plurality of switches, one for each player. Each switch selectively connects one portion of the circuit with another portion of the circuit in at least two different ways. The circuit comprises part of a complete electrical circuit whenever the terminals are connected and the switches connect the circuit together in an electrically complete manner. The power source is of sufficient strength to actuate the sound signal mechanism but not powerful enough to harm a player so that the terminals can be electrically connected by a human body. The circuit is located in a heart shaped housing and the switches are located on an arrow piercing the heart. A chance spinner is used to determine which body parts players are to connect to complete the circuit.

2. U.S. Pat. No. 3,404,889, invented by Warner III, entitled "Electrical Game Apparatus Having Multiple Circuit Paths To Be Selectively Completed And Interrupted By Opposing Players"

The patent to Warner III describes an electrical game apparatus having two playing areas concealed from one another. Corresponding grid networks are associated with each of the playing areas, each network having a multiplicity of circuit junctions, each junction being provided with a switch. These are selectively operated by either player for opening or closing the circuit paths through one of his junctions. This switching operation at the same time performs the same function at the corresponding junction on the opponent's playing area, the opponent however not knowing which switch was thrown; The circuit connections are such that if corresponding switches are in the same position, the corresponding junctions are open, whereas if the switches are differently positioned, the junctions are closed. Test means are provided to each player for testing circuit paths for continuity.

3. U.S. Pat. No. 5,482,277, invented by Young, entitled "Method Of Operating A Talking Crystal Ball Toy"

The patent to Young describes a talking crystal ball toy operatively electrically effective to respond to a previously asked question in which the battery-operated circuit providing this operating mode is completed through the body of the user which significantly enhances the play value of the toy.

4. U.S. Pat. No. 3,119,563, invented by Ruffman, entitled "Novelty Device"

The Ruffman invention relates generally to novelty devices, and more particularly to such a device having a structural form which is ornamental and is equipped with the elements of an open electric circuit adapted to be closed to energize the element thereof responsive to a current of electricity, such as an electric light bulb, a buzzer, a vibrator, or other electrical unit. Heretofore, novelties such as illuminated brooches, earrings, ornaments and the like have been made, both of the steady burning and the flashing light type, but in every such known instance the device has been merely an illuminable object of the character which its descriptive name clearly identifies. The present invention, on the other hand, is based upon an entirely different concept, although it necessarily utilizes some elements basically similar to those found in the devices referred to. In its broader aspects, the concept of the present invention contemplates a device of the character described wherein the closing of the electric circuit involves more than merely the actuation of a switch means. On the contrary, it provides a device having an open electric circuit including a pair of contacts arranged in predetermined separate locations and adapted to be bridged only by a circuit closing device having an electricity conducting element arranged in predetermined manner whereby the element will register with said contacts to engage and bridge them.

5. U.S. Pat. No. 4,508,520, invented by Sellers et al., entitled "Heart-Shaped Light-Emitting Novelty"

The patent to Sellers et al. describes a light-emitting novelty device having a heart-shaped convex-concave, light transmitting cover; a flat rear cover; and an electrical circuit including a lamp, a battery, and a momentary switch for turning on the lamp as long as the switch is continuously manually activated and turning off the lamp as the activation is discontinued.

6. U.S. Pat. No. 4,836,823, invented Laven, entitled "Heart Shaped Novelty Item"

The patent to Laven describes a novelty item having a heart shaped housing with a translucent window formed therein. The housing has two conductors formed on the exterior thereof. When the housing is held in a person's hand, a conductive path is formed between the two conductors, and one or more LEDs on the interior of the housing begin to flash on and off in symbolic representation of a beating heart. The flashing of the LEDs can be perceived through the translucent window. A stand can be provided to support the housing in an upright position.

7. U.S. Pat. No. Des. 346,458, invented by Ferrante, entitled "Light Display Article"

The design patent to Ferrante describes an ornamental design for a lighted display article.

8. U.S. Pat. No. 5,466,181, invented by Bennett et al., entitled "Doll Having Conducive Outer Skin Areas And Internal Battery Supply"

The patent to Bennett et al describes a doll, which includes a hollow torso within which a battery power source is supported. The doll further includes a pair of outer surface areas supporting coating or deposits of conductive material. Electrical connection is provided between the conductive outer surface areas and the internal battery power source. A plurality of electrical toy apparatus such as a music or sound producing device or a lighted mirror are provided with conductive pads and electrical connection thereto. In the anticipated play pattern, the doll contacts the electrical apparatus conductive pads using the conductive outer areas of the doll's outer surface to provide electrical connection between the internal battery power supply of the doll and the electrical toy apparatus. Thereafter and so long as the contact is maintained, the battery source within the doll powers the electrical apparatus to provide the desired effect.

9. U.S. Pat. No. 4,765,623, invented by Cardillo et al., entitled "Talking Crystal Ball Toy"

The patent to Cardillo et al. describes a talking crystal ball toy which is activated by a double pass of the operator's hands over a photosensor to give a randomly selected verbal response to a question asked by the operator.

10. U.S. Pat. No. 4,237,647, invented by Shaw, entitled "Soft Toy Containing Sounding Device"

The patent to Shaw describes a soft toy having a greater degree of appeal than normal soft toys. The toy, which may for example be a teddy bear, panda, or other animal, has two electric contacts disposed at spaced-apart regions of the exterior of the toy, there being contained within the toy an electrically operated device for producing a noise, such as a musical tune, when the contacts are bridged by being touched by a child or other user.

The above-listed patent to Breslow represents the closest prior art to the present invention. The Breslow patent, issued in 1974 and now expired, describes an electric game with an incomplete circuit, sound signal mechanism and power source connected to the circuit. The game includes a switch for each player, each switch selectively connecting one portion of the circuit with another portion of the circuit. Players are asked "yes" and "no" questions in the preferred mode and move their switches to certain positions accordingly. If both players answer in the same manner and the switches match, a chance spinner is used to determine which body parts players are to connect to one another complete the circuit, resulting in a bell sounding.

In contrast to the above, the present invention is a plastic, heart-shaped apparatus comprising two metal contacts, a sound module, speaker, and illumination means. When two persons touch each metal contact an incomplete, low-voltage power circuit is created. When the players kiss, the circuit is completed and a random sound or light occurs, indicating of whether or not the players share true love. Unlike the patent to Breslow which describes a game with previously-determined outcomes based upon "if-then" type responses, the present invention randomly "decides" on its own whether the persons are a suitable match. As such, the unpredictability of the invention can be expected to provide amusement and entertainment for multiple players of many age groups.

SUMMARY OF THE INVENTION

As noted, the present invention is a heart-shaped amusement device, including an electrical circuit means. Both a left and right side of the device include at least one metal contact, such that when the device is held by two persons touching each respective contact, an incomplete, low-voltage power circuit is created. The intended result of the device is that when the two players have physical contact (specifically kiss), the circuit is completed, and a random sound and/or random type of light occurs through a sound module, speaker, and illumination means. For amusement purposes, the random sound and/or random type of light may be indicative of whether or not the players share a relationship such as true love.

According to the foregoing, it is an object of the present invention to provide an entertaining device which may be used by multiple combinations of players.

It is a more particular object of the invention to provide an entertaining device which may be used at a party or other social setting.

It is a further goal of the present invention to provide an amusement device that generates sound and illumination in random and unpredictable patterns, to enhance the entertainment value of the item.

It is a goal of the invention to provide a device that determines whether players are compatible with one another, predicting the success or failure of an intimate relationship between such persons.

It is an additional goal of the invention to provide a device that determines whether players are compatible with one another, in varying increments or levels of compatibility, manifested by previously determined types of sounds and lights emanating therefrom.

It is a goal of the invention to provide an amusement device that may be constructed in varying sizes.

It is a further goal of the present invention to provide an entertaining device that may bear various colors and patterns thereon.

It is a further goal of the present invention to provide an amusement device that may bear indicia thereon, such indicia relating to a previously determined theme or style.

It is a goal of the invention to provide an amusement device that functions effectively without the usage of complex or expensive power means.

It is a further goal of the present invention to provide an amusement device that is substantially lightweight and constructed of relatively inexpensive materials.

Finally, it is an aim of the present invention to provide an entertaining device that may be manufactured with relative ease.

In total, the novel features considered characteristic for the invention are set forth in the claims. The invention itself both as to its construction and method of operation, will be best understood from the following description of the embodiments when read and understood in connection with the drawings provided.

BRIEF DESCRIPTION OF PREFERRED EMBODIMENTS

DETAILED DESCRIPTION OF THE PREFERRED EMBODIMENT

Figure 1A:
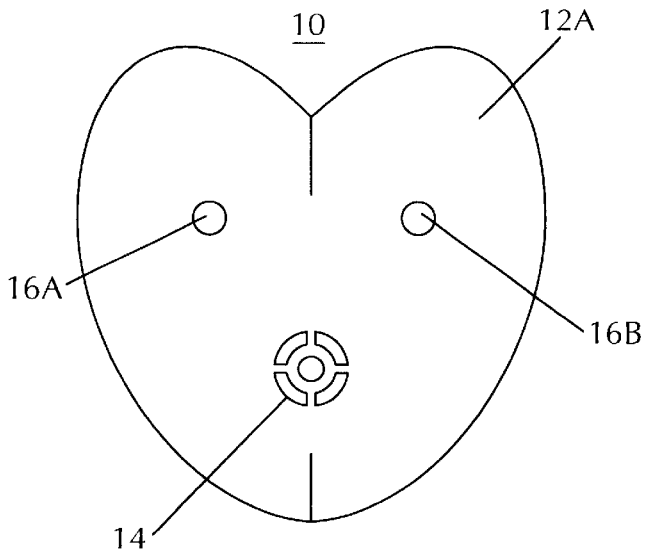
FIG. 1A is a front perspective view of the amusement device with electrical circuit means, illustrating general heart-shaped configuration with first metal contact, second metal contact, and speaker means.
Figure 1B:
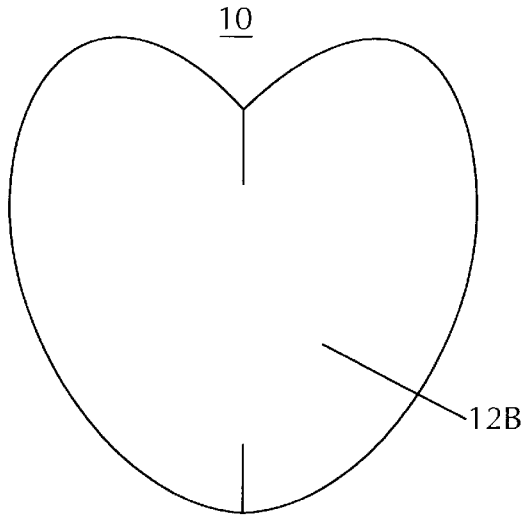
FIG. 1B is a rear perspective view of the amusement device with electrical circuit means.

The aforementioned amusement device with electrical circuit means (10) is based primarily upon a heart-shaped housing, shown in FIGS. 1A and 1B, which comprises an exterior surface (12A) and interior area formed in the cavity therein. The enclosed interior area comprises a power source (18), which in the preferred mode is a simple battery or batteries, depending upon complexity of the device and desired using life.

Figure 2A:
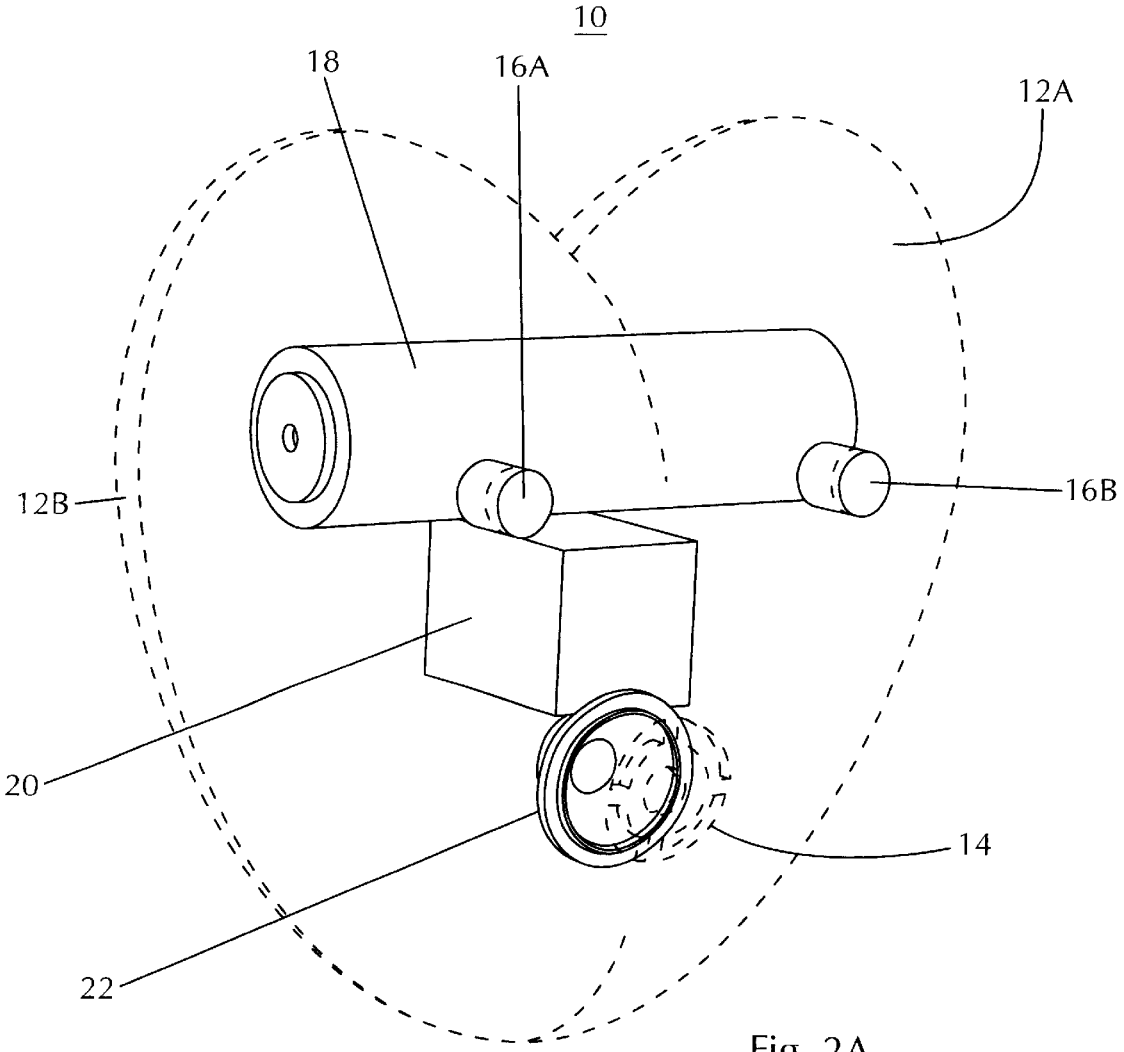
FIG. 2A is a front perspective cut-away view of the amusement device with electrical circuit means, illustrating possible location of the central processing unit, power means, speaker means, and metal contacts.
Figure 2B:
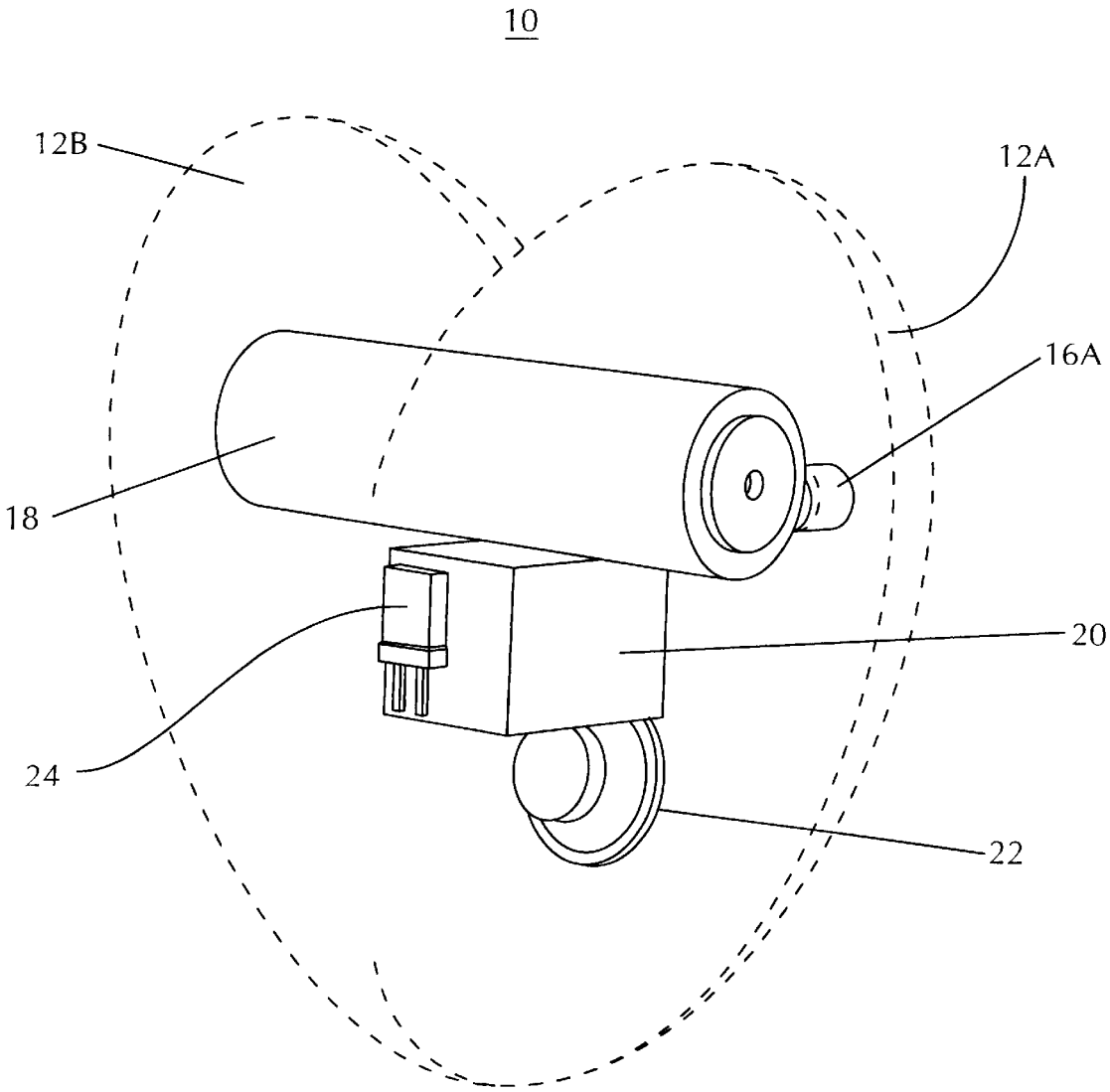
FIG. 2B is a rear perspective cut-away view of the amusement device with electrical circuit means, illustrating possible location of the central processing unit, power means, speaker means, and illumination means.

Next, as illustrated in FIGS. 2A and 2B, a substantially low voltage incomplete power circuit exists within the interior portion, as well as a central processing unit (20), and a speaker means (22). The speaker (22) extends from the interior portion through an aperture (14) located upon the front exterior surface (12A) of the device, located at a position substantially centered upon the heart, in the preferred mode of production. However, in alternate modes, the speaker (22) may emanate from the rear exterior surface (12B), should benefits of such a configuration be found.

Figure 1C:
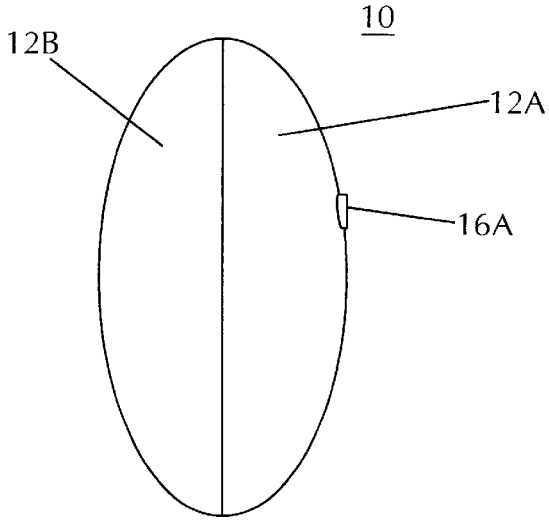
FIG. 1C is a side perspective view of the amusement device with electrical circuit means.

The left side of the heart-shaped housing comprises a metal contact (16A) upon the exterior surface thereof, preferably upon the front facing side (12A) of the heart. Similarly, the corresponding right side of the heart-shaped housing comprises an identical metal contact (16B) upon the exterior surface thereof, also upon the front side (12A) in the preferred mode, as shown in FIG. 1C.

Importantly, the touching of the left side metal contact (16A) by a first person, along with the touching of the right side metal contact (16B) by a second person extends the incomplete electrical circuit provide by the device (10). Therefore, subsequent touching of the first person and second person to each other causes the substantially low voltage power circuit to become complete.

In the preferred form of usage, the first person and second person kiss in order to complete the low voltage circuit. The completion of the circuit engages the central processing unit (20) for the purpose of selecting "responses" of the device, such responses intended to represent a level of compatibility between the first person and second person. For example, the processing unit (20) may direct a sound module located within the interior portion of the device to play at least one random, unpredictable sound through usage of the aforementioned speaker means (22). Either as an alternate to the sound means, or to be used in conjunction with the same is an illumination means (24) which may be used by the device (10).

To add to the versatility of the amusement device (10), multiple sounds played by the device will represent varying degrees of compatibility of the first person and second person. For instance, the quantity of available sounds to be played may be selected from a group consisting of 2, 3, 4, 5, 6, 7, 8, 9, and 10. The volume or character of the particular sounds or the quantity of such sounds played may represent how compatible the persons in question are, each level given a name or label to represent such match or lack thereof. Accordingly, the device (10) may bear indicia upon the exterior surface thereof, and such may be in form of brief text.

Furthermore, multiple lights (24) may be displayed by the device to represent varying degrees of compatibility of the first person and second person. For instance, the quantity of available lights (10) to be displayed may be selected from a group consisting of 2, 3, 4, 5, 6, 7, 8, 9, and 10. In this instance, the color of the particular lights (24) or the quantity of lights (24) displayed may represent how compatible the persons in question are, each level given a name or label to represent such match or lack thereof. In any such case, the lights may be simple LED lights (24), in order to provide a unique item that is relatively inexpensive and convenient to manufacture.

Moreover, it is important to note that the exterior surface of the device (12A, 12B) may be generally transparent or generally translucent, so as to allow the user to see the mechanism within the interior portion of the device, for the purpose of novelty and enhanced entertainment.

In all such modes, the heart-shaped housing (12A, 12B) is intended to be constructed of a strong, substantially lightweight material, such as plastic. This allows the device (10) to be manufactured at relatively low costs, as well as allowing for ease in shipment and for carrying upon one's person.

In total, the device (10) described herein is suitable for usage by persons at a variety of parties, gatherings, or social events, and can be expected to generate interest and provide entertainment to multiple persons of many age groups. The random, unpredictable reactions of the device (10) allow for users to speculate upon the potential successes or failure of prospective love relationships, much to the amusement of the players utilizing the apparatus.

While the invention has been described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

I claim:

1. An amusement device an with electrical circuit comprising:

a heart-shaped housing, which comprises an exterior surface and interior area formed therein, the interior area comprising a power source which comprises at least one battery, the heart-shaped housing further comprising a substantially low voltage incomplete power circuit, a central processing unit, and a speaker, the housing comprising indicia upon the exterior surface thereof, a left side of the heart-shaped housing comprising a metal contact upon the exterior surface thereof, and a right side of the heart-shaped housing comprising a metal contact upon the exterior surface thereof; a center portion of the heart-shaped housing comprising an aperture thereon, through which the speaker protrudes from the interior area; touching of the left side metal contact by a first person, touching of the right side metal contact by a second person, and subsequent touching of the first person and second person to each other in the form of the first person and second person kissing, causing the substantially low voltage power circuit to become complete, completion of said circuit causing the central processing unit to direct a sound module to play at least one random, unpredictable sound through usage of the speaker, said sound intended to represent a level of compatibility between the first person and second person with multiple sounds representing varying degrees of compatibility between the first person and second person; and completion of said circuit further causing the central processing unit to direct an illumination source to display at least one random, unpredictable light, said light intended to represent a level of compatibility between the first person and second person with multiple lights displayed represent varying degrees of compatibility between the first person and second person.

2. The amusement device with an electrical circuit as described in claim 1, wherein the quantity of available sounds to be played is selected from a group consisting of 2, 3, 4, 5, 6, 7, 8, 9, and 10.

3. The amusement device with an electrical circuit as described in claim 1, wherein the exterior surface is generally transparent.

4. The amusement device with an electrical circuit as described in claim 1, wherein the exterior surface is generally translucent.

5. The amusement device with an electrical circuit as described in claim 1, wherein the heart-shaped housing is constructed of plastic.

6. The amusement device with an electrical circuit as described in claim 1, wherein the quantity of available lights to be displayed is selected from a group consisting of 2, 3, 4, 5, 6, 7, 8, 9, and 10.

7. The amusement device with an electrical circuit as described in claim 1, wherein the device bears text upon the exterior surface thereof.

* * * * *